US009349503B1

(12) United States Patent
Teng

(10) Patent No.: US 9,349,503 B1
(45) Date of Patent: May 24, 2016

(54) GROUNDING CONDUCTIVE CABLE STRUCTURE

(71) Applicant: Yun-Chin Teng, Hsinchu County (TW)

(72) Inventor: Yun-Chin Teng, Hsinchu County (TW)

( * ) Notice: Subject to any disclaimer, the term of this patent is extended or adjusted under 35 U.S.C. 154(b) by 0 days.

(21) Appl. No.: 14/945,442

(22) Filed: Nov. 19, 2015

(51) Int. Cl.
*H01B 7/00* (2006.01)
*H01B 7/18* (2006.01)
*H01B 7/40* (2006.01)

(52) U.S. Cl.
CPC ..... *H01B 7/0009* (2013.01); *H01B 7/18* (2013.01); *H01B 7/40* (2013.01)

(58) Field of Classification Search
USPC ..... 174/78, 74 R, 110 R
See application file for complete search history.

(56) References Cited

U.S. PATENT DOCUMENTS 8,969,725 B2 * 3/2015 Mayer ..... H01R 9/032 174/74 R
9,018,529 B2 * 4/2015 Sidlyarevich ..... H01B 7/04 174/110 R

* cited by examiner

*Primary Examiner* — Timothy Thompson
*Assistant Examiner* — Michael F McAllister
(74) *Attorney, Agent, or Firm* — CKC & Partners Co., Ltd.

(57) ABSTRACT

A grounding conductive cable structure includes a cable main body, two conductive terminals and a woven mesh layer. The cable main body includes copper wires, silver plated wires, silver wires and oxygen-free copper wires. The total number of these copper wires and the silver plated copper wires is 5,000 to 20,000, and the number of the copper wires is greater than the number of the silver plated copper wires. The conductive terminals are electrically connected to the two opposite ends of the cable main body and electrically connected to those wires. The cable main body is wrapped by the woven mesh layer.

10 Claims, 2 Drawing Sheets

GROUNDING CONDUCTIVE CABLE STRUCTURE

BACKGROUND

1. Field of Disclosure

The present invention relates to a conductive cable structure, and more particularly to a grounding conductive cable structure.

2. Description of Related Art

An electric circuit loop of a traditional vehicle electrical system includes a vehicle battery and some electrical load components (e.g., automobile illumination, ignition system, electronic control unit, sensor, idle speed motor, etc.) therein, and the vehicle battery supplies electrical power to the electrical load components.

However, if electrical conductive efficiency of the electric circuit loop of the traditional vehicle electrical system is not good, the electrical load components cannot be effectively operated so as to reduce overall vehicle performance.

Therefore, how to provide a solution to effectively solve the aforementioned inconvenience and shortages and to increase the competitiveness of industries shall be seriously concerned.

SUMMARY

In one aspect of the present invention is to provide a grounding conductive cable structure to overcome the defects and inconvenience of the prior art.

A grounding conductive cable structure includes a cable main body, two conductive terminals and a woven mesh layer. The cable main body includes a plurality of main-wire bundles, a plurality of subsidiary-wire bundles and an outer layer. Each of the main-wire bundles includes copper wires and silver-plated wires which are twisted in bundles together. The total number of the copper wires and the silver-plated wires is 5,000 to 20,000, and the number of the copper wires is greater than the number of the silver-plated wires. The subsidiary-wire bundles include silver wires, at least one first oxygen-free copper wire and at least one second oxygen-free copper wire. The outer layer wraps the main-wire bundles and the subsidiary-wire bundles together as one. The conductive terminals are respectively coupled to two opposite ends of the cable main body with soldering, and electrically connected to the main-wire bundles and the subsidiary-wire bundles. The woven mesh layer covers the outer layer.

According to one or more embodiments of the present disclosure, a diameter of each of the copper wires is in a range from 0.04 mm to 0.08 mm.

According to one or more embodiments of the present disclosure, a diameter of each of the silver-plated wires is in a range from 0.04 mm to 0.08 mm.

According to one or more embodiments of the present disclosure, each of the silver wires is provided with a shielding layer having Teflon material.

According to one or more embodiments of the present disclosure, a diameter of each of the silver wires is in a range from 1 mm to 2 mm.

According to one or more embodiments of the present disclosure, the grounding conductive cable structure further comprising two tin-silver solder layers, each of the tin-silver solder layers is connected each of the two conductive terminals and one of the two opposite ends of the cable main body.

According to one or more embodiments of the present disclosure, each of the silver wires is a silver wire having 4N purities, each of the first oxygen-free copper wire is an oxygen-free copper wire having 4N purities, and each of the second oxygen-free copper wire is an oxygen-free copper wire having 6N or 7N purities.

According to one or more embodiments of the present disclosure, a diameter of each of the second oxygen-free copper wire is in a range from 0.1 mm to 0.2 mm.

According to one or more embodiments of the present disclosure, the main-wire bundles are arranged between a plurality of the at least one first oxygen-free copper wires and a plurality of the at least one second oxygen-free copper wires, wherein the first oxygen-free copper wires and the second oxygen-free copper wires are respectively twisted in bundles together.

According to one or more embodiments of the present disclosure, each of the conductive terminals is a conductive terminal having gold-plated material.

To sum up, the grounding conductive cable structure is not limited to use for grounding electric devices or vehicle. For example, when the grounding cable structure is grounded to a ground of a vehicle, by the characteristics of high electrical conductivity and low impedance of the grounding cable structure, the grounding cable structure can enhance the power usage efficiency of the overall electrical load, stabilize ground potential of a battery power of the vehicle, and reduce noise of electrical current, so that performance of the engine running and fuel efficiency can be increased.

It is to be understood that both the foregoing general description and the following detailed description are by examples, and are intended to provide further explanation of the disclosure as claimed.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
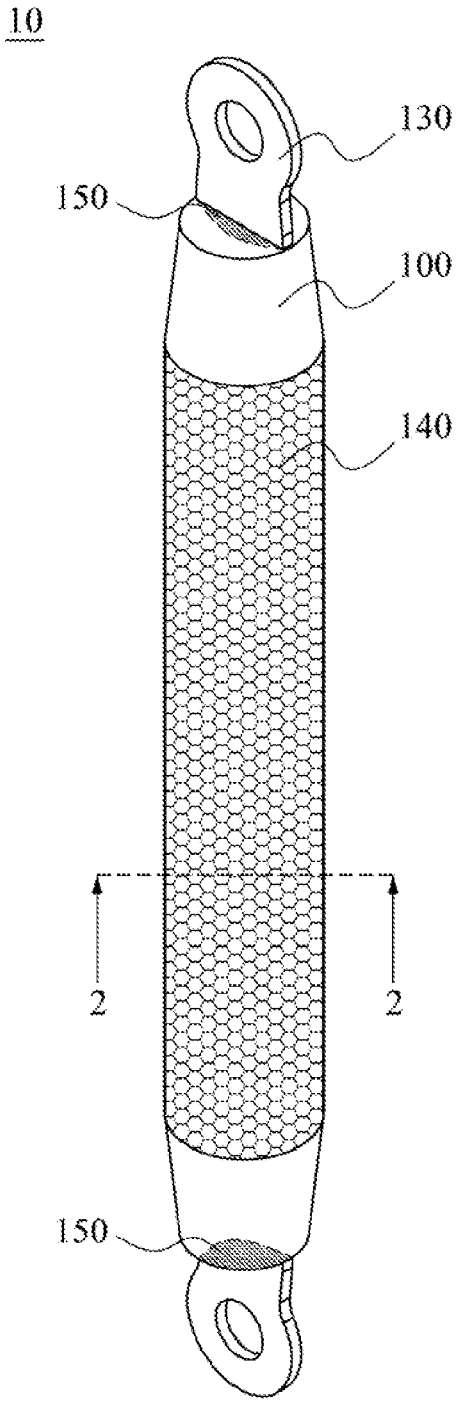
FIG. 1 is a perspective view showing a grounding conductive cable structure according to one embodiment of the present invention.

Reference will now be made in detail to the present embodiments of the disclosure, examples of which are illustrated in the accompanying drawings. Wherever possible, the same reference numbers are used in the drawings and the description to refer to the same or like parts. According to the embodiments, it will be apparent to those skilled in the art that various modifications and variations can be made to the structure of the present disclosure without departing from the scope or spirit of the disclosure.

Figure 2:
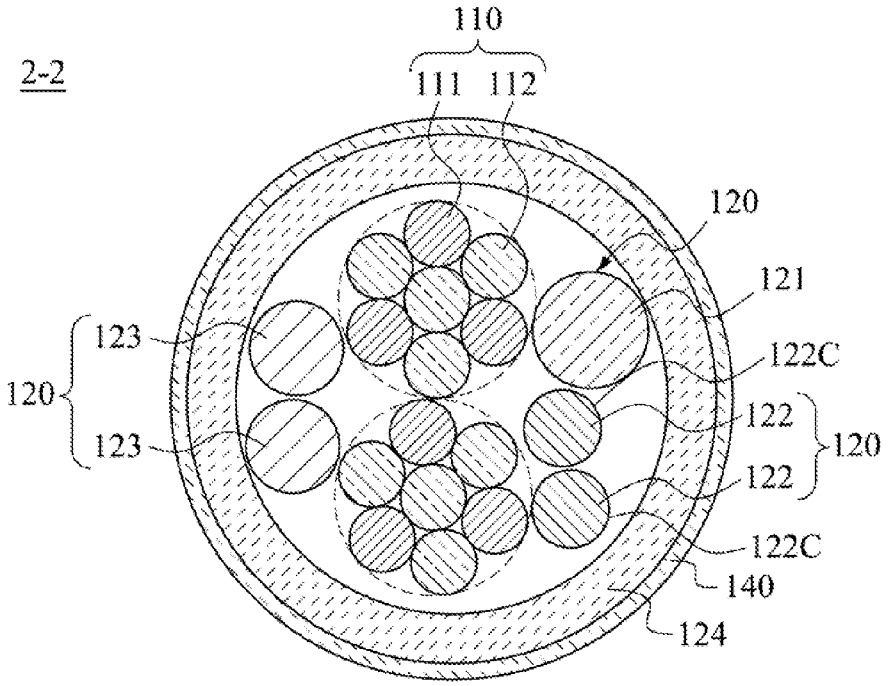
FIG. 2 is a cross-sectional view taken along line 2-2 of FIG. 1.

Reference is now made to FIG. 1 and FIG. 2 in which FIG. 1 is a perspective view showing a grounding conductive cable structure 10 according to one embodiment of the present invention. FIG. 2 is a cross-sectional view taken along line 2-2 of FIG. 1. As shown in FIG. 1 and FIG. 2, the grounding conductive cable structure 10 includes a cable main body 100, two conductive terminals 130 and a woven mesh layer 140. The cable main body 100 includes a plurality of main-wire bundles 110 (e.g., two bundles thereof, FIG. 2), a plurality of subsidiary-wire bundles 120 (e.g., three kinds thereof, FIG. 2) and an outer layer 124 (e.g., isolation layer). Each of the main-wire bundles 110 includes copper (Cu) wires 111 and silver-plated wires 112 which are twisted in bundles together. The subsidiary-wire bundles 120 includes silver (Ag) wires 122 (e.g., 2 cores thereof, FIG. 2), at least one first oxygen-free copper wire 121 and at least one second oxygen-free copper wire 123. The outer layer 124 wraps the main-wire bundles 110 and the subsidiary-wire bundles 120 together as one. The conductive terminals 130 are respectively coupled to two opposite ends of the cable main body 100 with soldering processes. The conductive terminals 130 are electrically connected to the main-wire bundles 110 and the subsidiary-wire bundles 120. The woven mesh layer 140 covers the outer layer 124, the main-wire bundles 110 and the subsidiary-wire bundles 120.

Specifically, the total number of the copper wires 111 and the silver-plated' wires 112 can be in a range from 5,000 to 20,000, and the number of the copper wires can be greater than the number of the silver-plated wires. Exemplarily, the total number of the copper wires 111 and the silver-plated wires 112 can be 5,000 cores, 7,500 cores, 15,000 cores, 17,500 cores or 20,000 cores. A diameter of each of the copper wires 111 can be in a range from 0.04 mm to 0.08 mm. Exemplarily, the diameter of each of the copper wires 111 is about 0.06 mm. A diameter of each of the silver-plated wires 112 can be in a range from 0.04 mm to 0.08 mm. Exemplarily, the diameter of each of the silver-plated wires 112 is about 0.06 mm. However the invention is not limited thereto.

Therefore, in the embodiment, since each of the main-wire bundles 110 includes a great amount of the copper wires 111 and the silver-plated wires 112, and the diameter of each of the copper wires 111 and the diameter of the silver-plated wires 112 are quite thin, the main-wire bundles 110 enhances the power usage efficiency of the overall electrical load, stabilize ground potential of the battery power, so that large quantity of electrical current can be transmitted and inductance and capacitance of the electrical current can be decreased to approximately zero.

Furthermore, each of the silver wires 122, for example, can be a pure silver wire having 4N (99.99%) purities of silver (Ag). The diameter of each of the silver wires 122 can be in a range from 1.0 mm to 2.0 mm, for example, the diameter of each of the silver wires 122 is about 1.0 mm. The first oxygen-free copper wire 121 is a PCOCC (Pure Copper by Ohno Continuous Casting Process) wire having 4N (99.99%) purities of copper (Au). The diameter of the first oxygen-free copper wire 121 can be in a range from 1.0 mm to 2.0 mm, for example, the diameter of each of the first oxygen-free copper wire 121 is about 2.0 mm. The second oxygen-free copper wire 123 is a PCUHD (Pure Copper Ultra High Drawability) wire having 6N or 7N (99.9999% or 99.99999%) purities of copper (Au). The diameter of the second oxygen-free copper wire 123 can be in a range from 0.1 mm to 0.2 mm, for example, the diameter of each of the second oxygen-free copper wire 123 is about 0.17 mm. The number of the second oxygen-free copper wire 123 can be in a range from 10 cores to 150 cores and exemplarily, the number of the second oxygen-free copper wire 123 can be about 52 cores. Thus, since the first oxygen-free copper wire and the second oxygen-free copper wire have characteristics of non-directional, high purity, anti-corrosion, and low electrical impedance, loss on voltage and signal of the electrical power can be reduced, so as to provide high speed and good quality of signal transmissions.

However, in other embodiment, each of the silver wires is not limited to have 4N (99.99%) purities of silver (Ag); the first oxygen-free copper wire 121 is not limited to have 4N (99.99%) purities of copper (Au); and the second oxygen-free copper wire 123 is not limited to have 6N or 7N (99.9999% or 99.99999%) purities of copper (Au).

Furthermore, each of the silver wires 122 is provided with a shielding layer 122E completely wrapping thereof, and the shielding layer 122C is provided with Teflon® material. Thus, when transmitting electrical current, interference signals of the electrical current can be effectively filtered so as to improve power purification.

As shown in FIG. 2, in the cross-section of the grounding conductive cable structure 10, both of the silver wires 122 and the first oxygen-free copper wire 121 are arranged on one side of the main-wire bundles 110, and the second oxygen-free copper wires 123 are arranged on another side of the main-wire bundles 110, so that the main wire bunches 110 are arranged between the first oxygen-free copper wires 122 which are twisted in bundles together and the second oxygen-free copper wires 123 which are twisted in bundles together.

Also, in order to maintain the conductive performance of the grounding conductive cable structure 10, each of the conductive terminals 130 is a conductive terminal having gold-plated material, and a tin-silver solder layer 150 is used to electrically connect each of the two conductive terminals 130 and each end of the cable main body 100. The tin-silver solder layer 150 includes pure silver material and pure tin material in which the pure silver material is accounted for 4.7% of the overall proportion, and the pure tin material is with 4N (99.99%) purities of tin.

Figure 3:
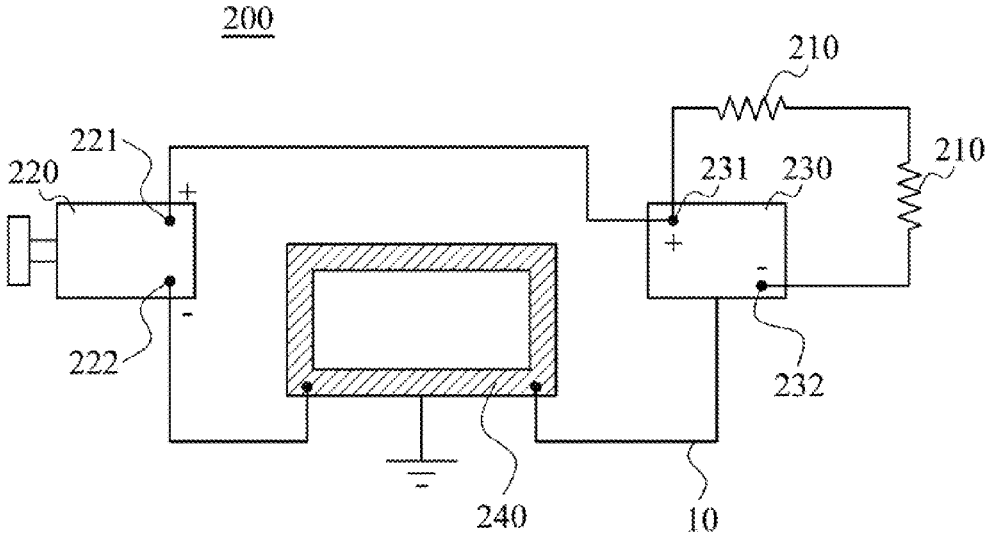
FIG. 3 is a schematic diagram showing a vehicle electric circuit loop according to another embodiment of the present invention.

FIG. 3 is a schematic diagram showing a vehicle electric circuit loop 200 according to another embodiment of the present invention. Briefly, the vehicle electric circuit loop 200 includes a plurality of electrical load components 210, a generator 220, a vehicle battery 230, and a ground 240 (e.g., vehicle steel body or the negative-electrode distributor). The electrical load components 210 of the vehicle battery 230 for example, can be automobile illuminations, ignition systems, electronic control units, sensors and idle speed motors etc. A positive electrode 231 of the vehicle battery 230 is electrically connected to the electrical load components 210. The ground 240 is electrically connected to a negative electrode 222 of the generator 220, the electrical load components 210 and a negative electrode 232 of the vehicle battery 230. A positive electrode 221 of the generator 220 is electrically connected to a positive electrode 231 of the vehicle battery 230 and the electrical load components 210. The grounding conductive cable structure 10 is electrically connected to the negative electrode 232 of the vehicle battery 230 and the ground 240 so as to stabilize ground potential of the negative electrode 232 of the vehicle battery 230, and reduce noises of the electrical load components 210. For example, the generator 220, the vehicle battery 230, and all of the electrical load components 210 (including automobile illumination, ignition system, electronic control unit, sensors, idle speed motors, etc.) are electrically connected to a steel sheet body of a vehicle as the ground 240. The grounding conductive cable structure 10 is used to electrically connect the negative electrode 232 of the vehicle battery 230 and an area of the steel sheet body neighboring to the vehicle battery 230 so as to finish the vehicle electric circuit loop 200.

Therefore, with high conductivity and low impedance of the grounding conductive cable structure, the grounding cable structure can enhance the power usage efficiency of the overall vehicle electric circuit loop, stabilize ground potential of the vehicle battery, and reduce noise of electrical current, so that performance of the engine running and fuel efficiency can be increased, thereby reducing exhaust and energy consumptions in order to achieve the purpose of save energy and reduce carbon emission.

In details, since the grounding conductive cable structure provides high conductive performance, the grounding conductive cable structure stabilizes electrical potential of the vehicle electric circuit loop so that the electrical load components can be effectively operated in the vehicle electric circuit loop. For example, in the effectively operated environment of the vehicle electric circuit loop, an electronic control unit (ECU) of the vehicle as one of the electrical load components is able to enhance the efficiency performance of the vehicle for precisely sending out actuation signals to precisely control other electrical load components such as launching units, air conditioning units, and gas engine control unit, fuel injection unit and the gearbox.

Furthermore, with the connection of the grounding conductive cable structure to the vehicle, the high-voltage electronic ignition can be enhanced for smoothly mobilizing the vehicle, and stabilized in idle without shaking. Also, with the connection of the grounding conductive cable structure to the vehicle, the high-voltage electronic ignition can provide rapid acceleration and pause feels of the gearbox thereof can be obviously decreased for saving fuel of the vehicle. For example, as the grounding conductive cable structure of the invention is not installed to the vehicle yet, the gas pedal of the vehicle needs to be pressed ⅓ of the total pressed distance if the vehicle is accelerated to 120 KM/H; in contrast, as the grounding conductive cable structure of the invention is installed to the vehicle, the gas pedal of the vehicle only needs to be pressed ¼ of the total pressed. Thus, it is clear to tell that fuel consumption of the vehicle is reduced, and the original automatic power of the vehicle is back to default factory settings.

Namely, an engine and a gearbox of any vehicle are respectively made and tested in their own upstream factories, after that, the engine and the gearbox of the vehicle are assembled together in a final factory. Since the engine and the gearbox of the vehicle are cooperated with each other, the total performance might be at least lost a certain degree (e.g., 10%). Thus, as the grounding conductive cable structure 10 of the invention is installed to the vehicle, the lost certain degree (e.g., 10%) of the total performance can be compensated back to the vehicle.

Back to FIG. 3, after the engine of the vehicle is started, the generator 220 generates and provides positive voltage (current) 230 directly to the vehicle battery 230, and the negative electrode 222 of the generator 220 and the negative electrode 232 of the vehicle battery 230 are electrically connected to the vehicle steel body (i.e., ground 240). Therefore, as the grounding conductive cable structure 10 of the invention is replaced with the connection of the negative electrode 232 of the vehicle battery 230 and the vehicle steel body (Le ground 240), the positive electrode 221 of the generator 220 is electrically connected to the positive electrode 231 of the vehicle battery 230, and the negative electrode 232 of the vehicle battery 230 is electrically connected to the vehicle steel body (i.e., ground 240) so as to define a rapid loop leading the engine, the electronic control nit (ECU), the gearbox and other electrical load components of the vehicle to have greater performance and working stabilization so as to further improve the automotive power and fuel saving.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A grounding conductive cable structure comprising:

a cable main body comprising:

a plurality of main-wire bundles, each of the main-wire bundles comprising copper wires and silver-plated wires which are twisted in bundles together, wherein a total number of the copper wires and the silver-plated wires is in a range from 5000 to 20,000, and the number of the copper wires is greater than the number of the silver-plated wires;

a plurality of subsidiary-wire bundles comprising silver wires, at least one first oxygen-free copper wire and at least one second oxygen-free copper wire; and an outer layer wrapping the main-wire bundles and the subsidiary-wire bundles together as one;

two conductive terminals respectively coupled to two opposite ends of the cable main body with soldering, and electrically connected to the main-wire bundles and the subsidiary-wire bundles; and a woven mesh layer covering the outer layer.

2. The grounding conductive cable structure of claim 1, wherein diameter of each of the copper wires is in a range from 0.1 mm to 0.2 mm.

3. The grounding conductive cable structure of claim 2, wherein a diameter of each of the silver-plated wires is in a range from 0.1 mm to 0.2 mm.

4. The grounding conductive cable structure according to claim 1, wherein each of the silver wires is provided with a shielding layer having Teflon material.

5. The grounding conductive cable structure according to claim 1, wherein a diameter of each of the silver wires is in a range from 1.0 mm to 2.0 mm.

6. The grounding conductive cable structure according to claim 1, further comprising two tin-silver solder layers, each of the tin-silver solder layers is connected each of the two conductive terminals and one of the two opposite ends of the cable main body.

7. The grounding conductive cable structure according to claim 1, wherein each of the silver wires is a silver wire having 4N purities, each of the first oxygen-free copper wire is an oxygen-free copper wire having 4N purities, and each of the second oxygen-free copper wire is an oxygen-free copper wire having 6N or 7N purities.

8. The grounding conductive cable structure according to claim 1, wherein a diameter of each of the second oxygen-free copper wire is in a range from 0.1 mm to 0.2 mm.

9. The grounding conductive cable structure according to claim 1, wherein the main-wire bundles are arranged between a plurality of the at least one first oxygen-free copper wires and a plurality of the at least one second oxygen-free copper wires, wherein the first oxygen-free copper wires and the second oxygen-free copper wires are respectively twisted in bundles together.

10. The grounding conductive cable structure according to claim 1, wherein each of the conductive terminals is a conductive terminal having gold-plated material.

* * * * *